United States Patent [19]

Beeghly

[11] 4,275,334

[45] Jun. 23, 1981

[54] INTEGRAL SPARK PLUG COIL FOR AIRCRAFT-TYPE PLUG

[75] Inventor: Bruce R. Beeghly, Youngstown, Ohio

[73] Assignee: The Economy Engine Company, Youngstown, Ohio

[21] Appl. No.: 85,897

[22] Filed: Oct. 18, 1979

[51] Int. Cl.[3] ..... H01J 7/44; H01J 17/34; H01J 19/78; H01K 1/62

[52] U.S. Cl. ..... 315/57; 123/169 R; 313/120; 313/143; 315/70

[58] Field of Search ..... 315/57, 58, 59, 70; 313/120, 143; 123/169 R

[56] References Cited

U.S. PATENT DOCUMENTS

| | | | |
|---|---|---|---|
| 2,070,708 | 2/1937 | Brokaw | 313/120 |
| 2,632,132 | 3/1953 | Delano | 315/57 |

*Primary Examiner*—Saxfield Chatmon, Jr.
*Attorney, Agent, or Firm*—Webb, Burden, Robinson & Webb

[57] ABSTRACT

An integral spark plug coil comprising a step-up coil within a canister which canister is mounted to an aircraft-type spark plug. The canister is secured to the barrel of the spark plug. A ceramic bushing having a hub-like shape is arranged within a metal sleeve defining part of the outer wall of the canister. The space adjacent the recessed terminal of the spark plug is in communication with ports in the metal sleeve through the small quenched space defined in part by an axial face of the ceramic bushing.

5 Claims, 2 Drawing Figures

INTEGRAL SPARK PLUG COIL FOR AIRCRAFT-TYPE PLUG

BACKGROUND

The concept of a step-up coil mounted directly on each spark plug of an internal combustion engine is over 50 years old. See, for example, U.S. Pat. Nos. 1,624,951; 1,722,269; 2,033,745; 2,180,358; 2,266,614; 2,414,692; 2,446,888; 2,455,960; 2,459,856; 2,467,531; 2,467,725; 2,482,884; 2,635,202; 3,716,038; 3,935,852; and 4,090,125. The major advantages of such an ignition system are (a) elimination of exposed high tension leads, (b) minimization of the length of the high tension leads thereby reducing losses due to the leakage current and capacitive loading, and (c) inherent safety resulting from the impossibility of disconnecting the coil from the plug with the primary connection plugged in.

However, despite these advantages the use of individual step-up coils with each spark plug of an internal combustion engine has not seen widespread use. One substantial reason has related to heating of the coil. The proximity of the coil (and the insulating materials associated therewith) to the spark plug results in the coil and the insulating materials being subjected to heat coming off of the engine. Modern materials go some distance to overcome this disadvantage. Even so, two other substantial problems remain with integral coils. Breakdown of the spark plug seals allows combustion gases in the engine cylinder to eventually leak to the termination area between the plug and the coil. This creates very high temperatures and pressures which can destory the coil electrically or even cause mechanical disintegration. In either event, the operator must replace not only the spark plug but the coil. Secondly, there has been a lack of a simple way of vertifying that the spark plug is firing when the coil surrounds the terminal atop the spark plug. A common method used with unshielded systems is a neon bulb indicator (see for example, Peters U.S. Pat. No. 2,181,149 and U.S. Pat. No. 2,245,604).

According to this invention there is provided an integral step-up coil spark plug for an internal combustion engine which overcomes the problems of spark plug leakage and enables easy verification that the spark plug is firing.

SUMMARY OF THE INVENTION

An integral spark plug step-up coil according to this invention comprises a typical aircraft-type spark plug which comprises a hollow cylindrical barrel which is threaded to the shell of the spark plug and extends away from a high voltage input terminal and which barrel is lined with a hollow cylindrical ceramic liner. The leads to the remainder of the ignitionn system are secured to the barrel of the spark plug by threads at the end of the barrel away from the terminal. The attaching leads must have an extension, preferably a spring-loaded extension, which reaches down into the barrel to contact the input terminal of the spark plug.

According to this invention, on top of the barrel is mounted a canister for containing the step-up coil, typically embedded in epoxy. A standard multiple contact electrical connector is secured to a cap over the top of the coil canister. Thus a lead with a standard multiple contact electrical connector attaches to the top of the coil canister. Extending from the coil canister into the barrel is an elongate insulated rigid lead which reaches down from the canister to engage the input terminal at the bottom of the barrel. Within the canister is a substantially coaxial bushing having the general shape of a wheel hub. The bushing has a central cylindrical bore in which the elongate insulated lead is journaled for limited axial movement. The end of the secondary output lead of the coil is attached to a disc-shaped terminal fitted to the end of the elongate lead. A coiled spring connector, for example, bridges the secondary lead terminal and the elongate lead. The canister has at least one port in the cylindrical wall. The port is alined with the ceramic bushing.

The bushing has an annular radial face that is at least in part adjacent to an annular flange at one end of the canister. The narrow gap between the radial face of the bushing and the flange comprising part of the sleeve is sized to permit the escape of gases from the barrel of the spark plug, first along the radial face of the bushing and then along the outer periphery of the bushing passing to the vicinity of the ports in the canister. The peripheral edge of the bushing which is adjacent the radial flange must have a diameter slightly less than the inner diameter of the canister or else the peripheral edge must have grooves thereon to allow gases to escape to the ports. The ports further provide a location where a firing indicator may be inserted to detect the electrical activity in the secondary circuit of the ignition system associated with the particular spark plug.

THE DRAWINGS

Further features and other objects and advantages of this invention will become clear from the following detailed description made with reference to the drawings in which FIG. 1 is a partial section through a step-up coil spark plug combination according to this invention, and FIG. 2 is a bottom view of a ceramic bushing useful in one specific embodiment of this invention.

DESCRIPTION OF THE PREFERRED EMBODIMENTS

Figure 1:
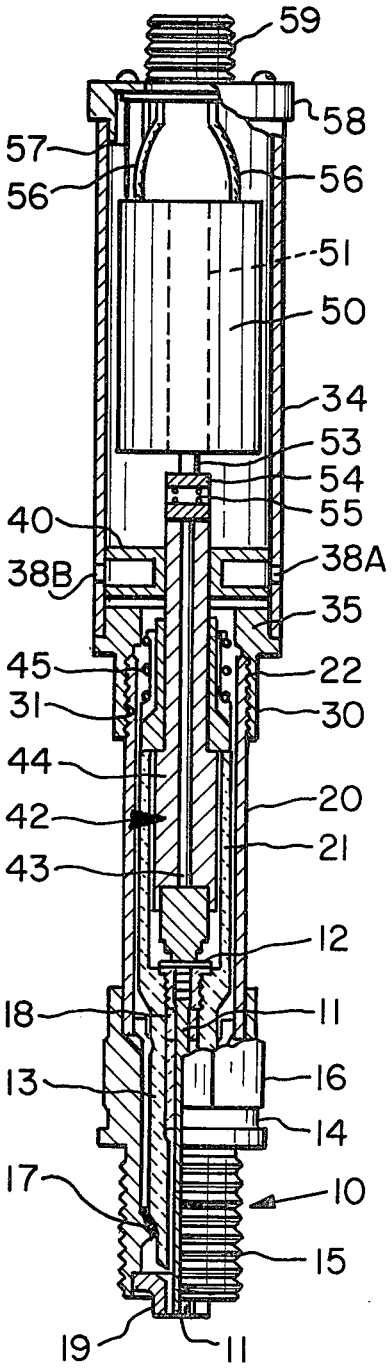

Rerferring now to the drawing, there is illustrated a spark plug 10 in partial section with an integral coil attached hereto. The spark plug comprises a center electrode 11 with a terminal 12 at the top end thereof. A tubular ceramic insulator 13 extends the entire length of the electrode and further as will be explained. Typically it is comprised of 96% by weight alumina ($A1_2O_3$). A shell 14 surrounds the ceramic insulator and has threads 15 at the lower end for threadably securing the spark plug into the combustion chamber wall. The shell carries an integral hex nut 16 for tightening the plug into the combustion chamber wall. An internal annular gasket or seal 17 fills the space between the shell 14 and the ceramic insulator 13. Yet another internal gasket or seal 18 is located between the electrode and the ceramic insulator. These gaskets or seals must contain the pressure of the combustion chamber. As with all gaskets and seals, they may leak, especially after extensive usage. This slight leakage, while not desirable, does not result in engine shutdown in the normal instance and is simply corrected by the next periodic spark plug change. If spark plugs do leak, very high temperature and pressure gases escape through the spark plug. Any container sealed to the top of the spark plug is then susceptible to being damaged by the gases as by being burst open by internal pressures or simply by having the insulator and other materials thereof damaged due to high temperatures. In the latter instance, when the spark plugs are changed it is also necessary to change the step-up coils.

Referring again to the drawing, the spark gaps are defined by the central electrode 11 and the ground 19 attached to the bottom face of the shell 14. Extending up from the shell and threaded thereto is a coaxial barrel 20. The diameter of the insulator 13 widens out into a larger cylindrical portion 21 which lines the barrel 20. The large cylindrical portion 21 of the insulator serves to protect against arcing within the spark plug. At the end of the barrel opposite of the shell are external threads 22 normally used to secure the lead wires to the barrel. The above described spark plug structure is traditional for aircraft applications. The spark plug need not be altered for use with an integral coil. The threads 22 are used to threadably engage the coil assembly with the spark plug.

Threadably secured to the barrel of the spark plug is a tubular sleeve 30. The sleeve 30 has, in the embodiment illustrated, internal threads 31 for engaging the external threads 22 of the spark plug barrel 20. The tubular sleeve 30 is machined from steel or the like. At the unthreaded end on the outside of the sleeve is an annular recess for receiving a tubular coil canister 34 providing a lap joint which can be braised or welded. Also, at the unthreaded end of the sleeve is a radial flange 35 defining the lower axial end wall of the canister 34.

An electrical insulating bushing 40 having bulb-like configuration is arranged substantially coaxial with the canister 34 adjacent the radial flange 35. The insulating bushing 40, preferably comprising a ceramic material, is comprised of a central cylindrical portion and integral therewith two parallel spaced disc portion in planes perpendicular to the cylindrical axis. The disc portions have central openings coaxial with the interior of the cylindrical portion. The bushing thus has a central bore. Also the bushing thus has a more or less hub-like configuration and may partially define an annular space between the two spaced discs. A variation of the hub-like configuration of the bushing would be an annular disc with a central bore clear through from radial face to radial face and with at least one radial bore from the cylindrical edge that extends toward but does not enter the central bore. In the central bore of the bushing 40 is journaled a rigid lead 42. The lead comprises an electrically conductive wire 43 surrounded by an electrically insulating shell 44. The rigid lead 40 is biased by spring 45 against terminal 12.

Ports 38A and 38B, etc. extend outwardly through the side of the canister 34 placing the annular space between the discs of the bushing in communication with the atmosphere.

Primary and secondary windings 50 wrapped around a core 51 are positioned within the coil canister 34. Extending downwardly from the winding is a secondary coil output lead 53 which terminates in a conductive plate 54. An electrically conductive spring 55 is compressed between the plate 54 and the rigid lead 42, thus completing the circuit from the secondary of the coil to the spark plug. Extending upwardly from the coil are primary input leads 56 and secondary ground lead 57.

The top of the coil canister carries a cap 58 secured thereto by rivet and/or braising or the like. To the cap is secured a standard multiple contact electrical connector 59.

The space within the canister surrounding the coil winding and leads is preferably filled with an epoxy compound.

The quenching space between the ceramic bushing 40 and the radial flange 35 is a critical feature of this invention. The width of the annular space and the radial length of the space must be such that no flame can traverse the space before being quenched. The difference in inner diameter of the radial flange and the inner diameter of the canister 34 determines the radial length of the quench space.

As shown in FIG. 1, the bushing 40 is in an exaggerated manner spaced from the flange 35. The actual distance would most likely not exceed 0.012 inches where the radial length of the quenching space is 0.25 inches or 0.014 inches were the radial quenching space is 0.5 inches. With these specific dimensions, the quenching space will satisfy the standards for explosion-proof enclosures established by the Canadian Standard Association for Class 1, Group D, Hazardous Location Service (CSA Standard C22.2 No. 30-1970). This quenching space permits the release of hot high pressure gases leaking from the spark plug and yet insures safety in hazardous atmospheres. Thus, this leakage through the spark plug seal can be safely vented rather than building up destructive pressures and temperatures within the coil canister.

Figure 2:
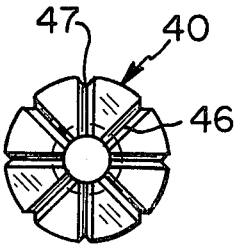

Referring now to FIG. 2, there is shown the bottom view of a bushing for use in a alternative embodiment of this invention in which the bushing 40 abuts the radial flange 35. The bottom of the bushing is cut to form grooves 46, for example, 0.012 inches deep on the radial surface and connected grooves 47 are cut on the periphery of the disc adjacent the flange 35.

The location of the ports 38A and 38B through the canister 34 is especially advantageous for yet another purpose. The ports enable the placement of a firing probe near the secondary output. The firing probe is simply a capacitive pick-up device which causes the illumination of a neon bulb due to the difference in the electrical potential of the hand of the person holding the firing indicator and the space adjacent the spark plug terminal. A much more complex solution to the same problem, that is, the problem of detecting the electrical activity in the secondary circuit, is illustrated in U.S. Pat.No. 4,090,125.

Having thus described this invention with the detail and particularity required by the Patent Laws, what is desired protected by Letters Patent is set forth in the following claims.

I claim:

1. In an ignition device comprising a step-up coil unit to be associated with an aircraft-type spark plug having a barrel extending up from the shell of the spark plug with threads on the portion of the barrel away from the shell, the improvement comprising said step-up coil unit comprising a tubular metal sleeve having threads for engaging the threads on the barrel of the spark plug, said sleeve defining a radial flange, an insulating bushing having a hub-like configuration arranged substantially coaxial with the sleeve such that a face of the bushing is adjacent the radial flange of the sleeve, and a coil canister sealed to said sleeve having said bushing and a step-up coil contained therein and there being at least one port in the side of the canister adjacent the bushing, a rigid lead journaled in the bushing for completing the electrical circuit between the coil secondary and the spark plug, the space between the radial flange and the bushing defining a narrow annular gap sized to quench a flame attempting to propagate therethrough, whereby upon leakage of the seals in the spark plug pressure does not build up in the spark plug barrel and coil canister but is released through the gap between the radial flange and the bushing and through the ports in the canister and whereby the condition of the spark plug can be checked by inserting a firing probe in the said at least one port.

2. The invention according to claim 1 wherein the radial length and width of the narrow annular gap is sized to satisfy explosion-proof standards.

3. The invention set forth in claim 1 wherein the narrow annular gap is no more than about 0.012 inches wide and the radial length of the gap is at least 0.25 inches.

4. The invention set forth in claim 1 wherein the bushing has radial grooves cut in a surface thereof with connecting peripheral grooves.

5. In an ignition device comprising a step-up coil unit to be associated with an aircraft-type spark plug, the improvement comprising said step-up coil unit comprising a coil canister with means for engaging the spark plug, said canister having an axial end face adjacent the spark plug;

an insulating bushing having a hub-like configuration arranged substantially coaxial with the canister such that a face of the bushing is adjacent the axial end face of the canister, and said coil canister having said bushing and step-up coil contained therein and there being at least one port in the side of the canister adjacent the bushing, a rigid lead journaled in the bushing for completing the electrical circuit between the coil secondary and the spark plug, the space between the axial end face and the bushing defining a narrow annular gap sized to quench a flame attempting to propagate therethrough, whereby upon leakage of the seals in the spark plug pressure does not build up in the spark plug barrel and coil canister but is released through the gap between the axial end face and the bushing and through the ports in the canister and whereby the condition of the spark plug can be checked by inserting a firing probe in the said at least on port.

* * * * *

UNITED STATES PATENT AND TRADEMARK OFFICE

CERTIFICATE OF CORRECTION

PATENT NO. : 4,275,334

DATED : June 23,1981

INVENTOR(S) : Bruce R. Beeghly

It is certified that error appears in the above-identified patent and that said Letters Patent are hereby corrected as shown below:

Column 1 Line 36 "vertifying" should read --verifying--.
Column 1 Line 54 "ignitionn" should read --ignition--.
Column 2 Line 42 "Rerferring" should read --Referring--.
Column 3 Line 30 "bulb-like" should read --hub-like--.
Column 4 Line 29 "a" (second occurrence) should read --an--.

Claim 5 - Column 6 Line 25 "on" should read --one--.

Signed and Sealed this

*Fifteenth* Day of *September 1981*

[SEAL]

*Attest:*

GERALD J. MOSSINGHOFF

*Attesting Officer* *Commissioner of Patents and Trademarks*